United States Patent [19]

Kawano et al.

[11] Patent Number: 4,594,043

[45] Date of Patent: Jun. 10, 1986

[54] BANKNOTE COUNTING AND BANDSEALING DEVICE

[75] Inventors: Hikaru Kawano, Odawara; Koji Sato, Hiratsuka; Hiroyoshi Nogi, Tokyo, all of Japan

[73] Assignees: Musashi Co., Ltd., Tokyo; Hitachi Denshi Engineering Kabushiki Kaisha, Kanagawa, both of Japan

[21] Appl. No.: 561,561

[22] Filed: Dec. 14, 1983

[30] Foreign Application Priority Data

Dec. 22, 1982 [JP] Japan ..... 57-223923

[51] Int. Cl.[4] ..... B65B 13/18

[52] U.S. Cl. ..... 414/43; 271/213; 414/225; 414/907

[58] Field of Search ..... 271/177, 178, 212, 213, 271/314; 414/28, 43, 103, 907, 225, 226, 749, 751, 753; 53/542

[56] References Cited

U.S. PATENT DOCUMENTS

| | | | |
|---|---|---|---|
| 3,131,932 | 5/1964 | Maidment | 414/907 X |
| 3,139,278 | 7/1964 | Maidment | 414/103 X |
| 4,229,136 | 10/1980 | Panissidi | 414/753 X |
| 4,343,582 | 8/1982 | Lundblad et al. | 414/43 X |
| 4,424,660 | 1/1984 | Sato et al. | 414/38 X |
| 4,531,344 | 7/1985 | Sato et al. | 414/43 X |

*Primary Examiner*—Robert J. Spar
*Assistant Examiner*—Janice Krizek
*Attorney, Agent, or Firm*—Brooks Haidt Haffner & Delahunty

[57] ABSTRACT

The banknote counting and bandsealing device has a banknote stacker supported on a supporting shaft so as to be movable longitudinally and rotatable between a first position receiving the banknotes and a second position aligned with a bandsealing position. The banknote stacker has a banknote presser and the banknotes stacked on the banknote stacker in the first position are clamped by said banknote presser and transferred in the thus clamped state to the bandsealing position by rotation of said banknote stacker to said second position.

3 Claims, 2 Drawing Figures

BANKNOTE COUNTING AND BANDSEALING DEVICE

BACKGROUND OF THE INVENTION

This invention relates to a device for counting the number of paper sheets such as banknotes and bandsealing the paper sheets whose number has been counted.

So far, various devices of this kind have been proposed in the art. Typical of these are a system in which the banknotes whose number has been counted are stacked at a stacker unit and transferred to a transfer belt whereby it is further conveyed to the bandsealing section; a system in which the banknotes whose number has been counted are stacked at a stacker and transferred to the bandsealing section as they are clamped between an upper endless belt and a lower endless belt; and a system in which the banknotes whose number has been counted are stacked at a stacker that is opened laterally and in the banknote delivery direction and are introduced by a pusher into the bandsealing section. In all of these systems, the banknotes are not clamped during transfer so that their transport state is unstable. Hence, the stack tends to run into disorder when introduced into the bandsealing section thus causing a great inconvenience in transport and bandsealing operations. Moreover, since the stacker part is separated from the transfer part, a larger number of component parts is required thus increasing manufacture costs and lowering an operational reliability.

SUMMARY OF THE INVENTION

It is therefore an object of the present invention to provide means highly effective to obviate the aforementioned disadvantages of the conventional device. According to the invention, a banknote stacker adapted to be rotatable and movable longitudinally has a banknote presser. The banknotes stacked in the banknote stacker upon termination of the counting operation are clamped by said presser and introduced in the thus clamped state into the bandsealing section along with the banknote stacker.

DESCRIPTION OF THE PREFERRED EMBODIMENT

Reference is had to the accompanying drawings for illustrating a preferred embodiment of the banknote counting and bandsealing device of the present invention.

Figure 1:
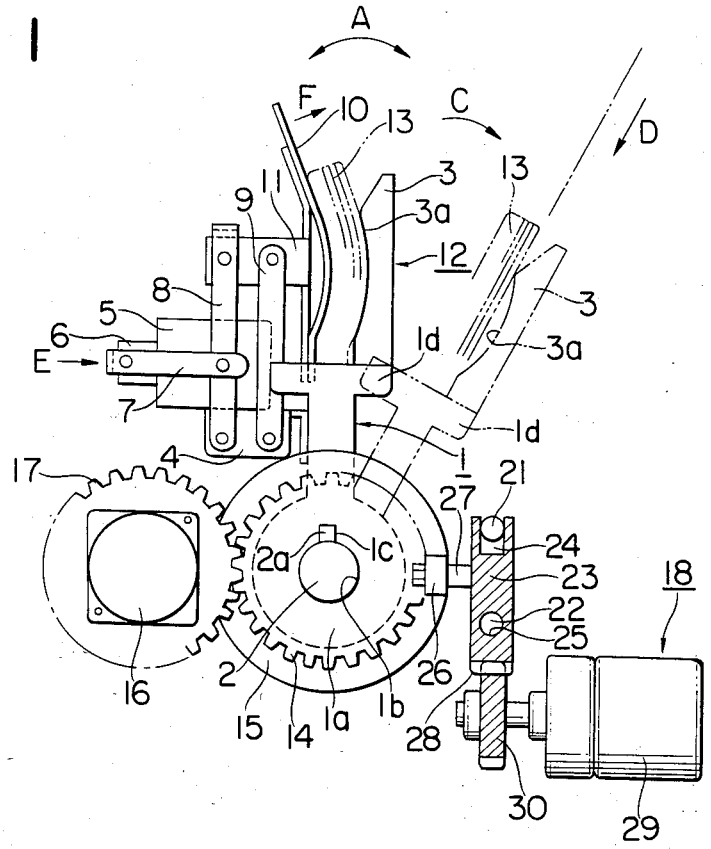
FIG. 1 is a side elevation of the banknote counting and banksealing device of the present invention, shown partly in section.
Figure 2:
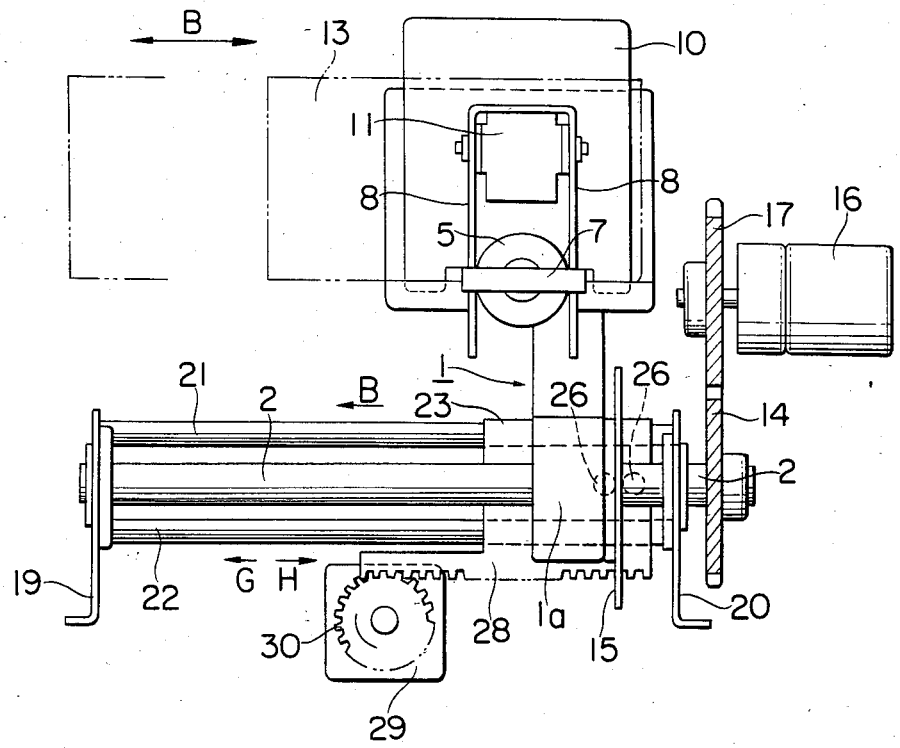
FIG. 2 is a front view of the device shown in FIG. 1, looking from the right-hand side and shown partly in section.

Referring to FIGS. 1 and 2, the numeral 1 designates a banknote stacker member mounted on a substantially horizontal supporting shaft 2, which is loosely fitted in a holding through-hole 1*b* provided in a root 1*a* of the stacker member 1. The shaft 2 has a longitudinal rib 2*a* slidably engaging in a guide recess 1*c* communicating with the holding through-hole. Thus the stacker member 1 may be rotated in unison with the supporting shaft 2, while being slidable lengthwise of the shaft 2, by reason of engagment of the rib 2*a* in the guide recess 1*c*.

A stacker piece 3 is mounted substantially upright on a substantially L-shaped stacker block 1*d* provided at the upper extremity of the banknote stacker member 1, and a concavely curved paper sheet receiving surface 3*a* is formed on the inner surface of the stacker piece 3. A solenoid 5 is mounted at a supporting member 4 provided at the lateral side of the stacker member 1. A plunger 6 operatively associated with the solenoid 5 carries a first arm 7 which is pivotally connected to substantially the center of a second arm 8 which in turn is pivotally connected at one end to said supporting member 4. Similarly, a third arm 9 is pivotally connected at one end to the supporting member 4. A presser 11 having an arcuately convex paper sheet pressing surface 10 is pivotally connected to the other ends of the second and third arms 8, 9. A banknote stacker 12 is made up of the stacker member 1 and the stacker piece 3, and the banknotes 13, only one of which is shown in FIGS. 1 and 2, are sandwiched and clamped in the curved or bent state between the stacker piece 3 and the pressing surface 10.

A rotary gear 14 is formed integrally with the supporting shaft 2 and a guide disk 15 is also mounted integrally with the root 1*a* of the stacker member 1. The gear 14 meshes with a turning gear 17 operatively connected to a turning electric motor 16. Upon actuation of the turning electric motor 16, the stacker member 1 is swung in the direction of the arrow mark A through the medium of the turning gear 17 and the rotary gear 14.

A transfer unit 18 acting as means for reciprocating the stacker 12 longitudinally of the supporting shaft 2 is mounted below the stacker 12, and has a pair of brackets 19, 20 adapted for supporting the aforementioned supporting shaft 2 and a pair of vertically spaced apart guide bars 21, 22.

A slider 23 is mounted slidably reciprocably on the guide bars 21, 22 in the direction of the double-headed arrow mark B, the guide bar 21 slidably engaging in a recess 24 formed on the upper part of the slider 23, and the guide bar 22 slidably engaging in a sliding through-hole 25 provided at the lower part of the slider 23. A connecting member 27 carrying a pair of guide rolls 26 is projectedly mounted at one lateral surface of the slider 23. These guide rolls 26 are engaged with both sides of the guide disk 15 so that the latter is sandwiched between the guide rolls 26. The lower part of the slider 23 is formed with a rack 28 meshing with a rotary gear 30 of a driving electric motor 29 as transfer driving source.

In the above construction, the operation of stacking and bandsealing the banknotes with the aid of the counting and bandsealing device of the present invention is now described. First of all, the turning electric motor 16 is activated so that the stacker member 1 is turned in the direction of the arrow mark C through the turning gear 17 and the rotary gear 14, and shifted in this manner from a first solid-line position in FIG. 1 in which it is aligned at a bandsealing position, not shown, to a second or double-dotted chain line position in FIG. 1 in which it is ready to receive the banknotes. In this state, the banknotes 13, that have passed through a counting step by a banknote counting unit, not shown, are supplied in succession by feed rolls, also not shown, in the direction D onto the stacker piece 3 where they are stacked. When the number of the banknotes 13 has reached a predetermined value (usually one hundred), it is sensed by a number senser, not shown, which then issues an output signal to the solenoid 5. Thus the solenoid is activated by this corresponding output signal and the plunger 6 is thereby urged in the direction of the arrow mark E at the same time that the pressing surface 10 is urged from the banknote release position to the banknote pressing position through the medium of the arms 7 through 9 as indicated by the arrow mark F. Thus the banknotes 13 stacked on the stacker piece 3 are sandwiched and clamped between the receiving surface 3*a* of the stacker piece 3 and the pressing surface 10.

As the clamping of the banknotes 13 by the stacker piece 3 and the pressing surface 10 has been sensed by a clamp sensor, not shown, an output signal is issued from the clamp sensor whereby the turning electric motor 16 is activated. With rotation of the turning motor 16, the stacker member 1 is turned through the medium of the turning gear 17, rotary gear 14, supporting shaft 2, rib 2*a* and the guide recess 1*c* and thereby shifted from the first or double-dotted chain-line position to the second or solid-line position in FIG. 1. As the stacker member 1 has been shifted in this manner to the substantially upright position, the driving electric motor 29 is activated. With rotation of the driving electric motor 29, the slider 23 is shifted through the rotary gear 30 in the direction of the arrow mark G in FIG. 2. Thus the stacker member 1 is moved on the supporting shaft 2 in the direction of the arrow mark G through the guide disk 15 clamped between the guide rolls 26 and by virtue of engagement of the rib 2*a* with the guide recess 1*c*. In this manner, the notes 13 are transported as they are clamped by the stacker piece 3 and the pressing surface 10 to a bandsealing unit as known per se (not shown), where it is subjected to bandsealing. Upon termination of the bandsealing operation, the solenoid 5 is turned off by a bandsealing end signal so that the clamping state is cancelled. The driving electric motor 29 is driven in reverse so that slider 23 is shifted in the opposite direction to the direction of arrow mark H and returned to its starting position. Simultaneously, the turning electric motor 16 is driven in reverse and thus the stacker member 1 is returned to the double-dotted chain-line position in FIG. 1 ready to start the clamping of the next bundle of the banknotes.

From the foregoing it will be apparent that the counting and bandsealing device of the present invention enables the stacked banknotes to be transported to the bandsealing section as they remain stacked by the stacker member and the presser. Since the banknotes are housed, as it were, within a cassette, when transported to the bandsealing section, there is no risk that the banknotes be subject during transport to eventual creasing, dropping, breakage or loss, since the bundle of banknotes is clamped extremely positively. In addition, since the stacker section and the transfer section are arranged in one unit, it is possible to reduce the number of components and hence manufacture costs while considerably improving operational reliability.

It should be noted that, while the case of handling the banknotes has been described in the present embodiment, similar effects may be attained with using paper sheets other than the banknotes. The manner in which the stacker is urged into rotary and translatory movements is not limited to that described in the aforementioned embodiment. For example, the stacker and the supporting shaft may be fixed to one another and the supporting shaft moved transversely.

What we claim is:

1. A banknote stacker movable between a stacking position and a bandsealing delivery position spaced from said stacking position, said stacker comprising:

a vertically extending presser wall and an opposed, stacker wall piece spaced from said presser wall for receiving banknotes therebetween, said presser wall being mounted for movement toward and away from said stacker wall piece;

mounting means mounting said stacker wall piece for rotation around a horizontal axis toward and away from said presser wall and mounting said presser wall and said stacker wall piece for movement from said stacking position to said bandsealing delivery position and vice versa, said mounting means comprising a rotatable shaft, said stacker wall piece being mounted on said shaft for rotation by said shaft but being slidable axially along said shaft;

first driving means for rotating said stacker wall piece around said axis and toward and away from said presser wall, said first driving means comprising energizable drive means connected to said shaft for rotating the latter;

second driving means for moving said presser wall toward and away from said stacker wall piece; and third driving means for moving said presser wall and said stacker wall piece from said stacking position to said bandsealing delivery position and vice versa.

2. A banknote stacker as claimed in claim 1 wherein said presser wall is a plate member convexly curved toward said stacker wall piece and wherein said second driving means comprises a solenoid connected to said plate member by pivotable links.

3. A banknote stacker as claimed in claim 1 wherein said third driving means comprises a guide plate secured to said stacker and slidably mounted on said shaft for movement axially of said shaft, a rack movable in the axial direction of said shaft, a slider mounted on said rack for movement therewith and slidably mounted on said shaft, said slider engaging said guide plate for moving said guide plate axially of said shaft, and energizable drive means connected to said rack for reciprocating said rack.

* * * * *